US012351368B1

(12) United States Patent
Zhu

(10) Patent No.: US 12,351,368 B1
(45) Date of Patent: Jul. 8, 2025

(54) CONTAINER WITH DETACHABLE SEALED STRAW

(71) Applicant: JINHUA HUALIANG VESSEL CO., LTD., ZheJiang (CN)

(72) Inventor: Xinghua Zhu, ZheJiang (CN)

(73) Assignee: JINHUA HUALIANG VESSEL CO., LTD., Jinhua (CN)

( * ) Notice: Subject to any disclaimer, the term of this patent is extended or adjusted under 35 U.S.C. 154(b) by 0 days.

(21) Appl. No.: 18/953,015

(22) Filed: Nov. 19, 2024

(30) Foreign Application Priority Data

Oct. 24, 2024 (CN) ..... 202411495397.6

(51) Int. Cl.
*B65D 47/06* (2006.01)

(52) U.S. Cl.
CPC ..... *B65D 47/068* (2013.01); *B65D 47/065* (2013.01)

(58) Field of Classification Search
CPC .... B65D 47/068; B65D 47/065; B65D 77/28; B65D 77/283; B65D 2231/022; B65D 2517/0049; B65D 2581/056; B65D 83/306; B65D 2251/105
See application file for complete search history.

(56) References Cited

U.S. PATENT DOCUMENTS

| | | | | |
|---|---|---|---|---|
| 5,244,113 | A * | 9/1993 | Stymiest | B65D 47/0885 215/396 |
| 6,783,019 | B2 * | 8/2004 | Zettle | B65D 47/0895 220/709 |
| 2003/0062367 | A1 * | 4/2003 | Robinson | A47G 19/2227 220/254.1 |
| 2006/0226110 | A1 * | 10/2006 | Choi | B65D 47/065 220/203.04 |
| 2010/0193462 | A1 * | 8/2010 | Roth | B65D 51/242 215/229 |
| 2019/0183269 | A1 * | 6/2019 | Kalisz | A47G 19/2266 |

* cited by examiner

*Primary Examiner* — Kareen K Thomas
(74) *Attorney, Agent, or Firm* — Nicholas Makridakis

(57) ABSTRACT

A container with detachable suction straw is disclosed, including a container and a lid assembly covering the container. The lid assembly comprises walls defining a recess, guiding grooves that facilitate assembly and easy removal of the detachable sealed straw, a rotating axis concave joint, and guiding grooves where the detachable sealed straw and the elastomeric seal are housed. The detachable sealed straw contains positioning balls and a spout, the spout is designed to have a body that rotates on the concave surface of the rotating axis joint of the lid assembly, a passage for the flow of contents within the container, a spout lead-in portion, a blind hole for assembling the positioning balls, and a handle. The elastomeric seal fits tightly into the lid assembly.

7 Claims, 11 Drawing Sheets

CONTAINER WITH DETACHABLE SEALED STRAW

CROSS REFERENCE TO RELATED APPLICATION

This application claims priority to Chinese Patent Application No. 2024114953976, filed on Oct. 24, 2024, which is hereby incorporated by reference in its entirety.

TECHNICAL FIELD

The present invention relates to the technical field of drinkware lids, particularly to a container with detachable sealed straw.

BACKGROUND

Beverage containers may be filled with hot or cold potable liquids such as water, coffee, tea, soft drinks, or alcoholic beverages like beer. These beverage containers may be made from various materials such as stainless steel, ceramic, glass, plastic, cardboard, or paper-based materials. A lid may be provided on the beverage container to provide an outlet for dispensing the contents of the beverage container. In some cases, it might be desirable to selectively close and store the container so that the contents do not spill over.

SUMMARY

The following provides a simplified introduction to certain general concepts related to the present invention, which will be further described in detail below in the Detailed Description section. It is not intended to identify key or essential features of the claimed subject matter.

In some embodiments of the present disclosure, it provides a container with detachable sealed straw, including a container and a lid assembly covering the container.

The lid assembly includes walls defining a recess, guiding assemblies facilitating installation and easy removal of the detachable sealed straw, and guiding grooves for housing the detachable sealed straw and accommodating an elastomeric seal.

The detachable sealed straw comprises positioning beads and a spout, the spout forming a body within the rotating axis concave joint surface of the lid assembly, a conduit for fluid flow of the container's contents, a spout lead-in, a blind hole for assembling the positioning beads, and a handle, enabling the detachable sealed straw to rotate between an opened position for consuming the container's contents and a sealed position.

The elastomeric seal is tightly assembled within the lid assembly, forming a seal when the detachable straw assembly is rotated into the sealed position, enclosing the container's contents; the detachable straw assembly forms an uninterrupted connection with the internal contents when rotated into the open position, while ensuring the airway remains unobstructed.

Herein the detachable sealed straw has the handle and the resiliently pivoting positioning beads being configured to pivot within the concave joint of the rotating axis of the lid assembly.

Herein the detachable sealed straw is configured to pivot between the closed position at the concave joint of the rotating axis of the lid assembly and the open position at the concave joint of the rotating axis of the lid assembly.

Herein the detachable sealed straw is configured to lock in place at the closed position and open position by the cap's concave joint, positioning beads, spout body of the detachable sealed straw, and frictional engagement of the compressed elastomeric seal, ensuring the component remains securely in position under normal handling conditions and prevents unintentional dislocation during usage or transport, thereby offering improved safety and user confidence in the container's integrity.

Herein the large cap also includes channels designed to receive the detachable sealed straw and the elastomeric seal, Herein the guiding grooves restrict lateral movement of the detachable straw assembly and allow a range of transverse movement.

Herein the detachable sealed straw is configured to be mounted onto the large cap and removable by hand, either directly pulling the spout lead-in and handle against the compression force of the positioning bead's balls or flipping around the axis outward leading to detachment of the spout via the compression of the positioning bead's balls from the cap.

Herein the large cap also includes channels designed to receive the detachable straw assembly, where the guiding grooves limit lateral movement and permit a range of transverse movement; when the detachable sealed straw is set above the channels receiving the detachable sealed straw, the user can directly press it into the concave joint of the rotating axis locking the detachable sealed straw, elastomeric seal, and large cap to form a seal. Alternatively, the detachable sealed straw can be placed in the open position and directly inserted into the guiding groove of the large cap's concave joint, then turned to lock the spout lead-in into the guide slot securing it in the sealed position.

Herein the axial compression force of the positioning bead is greater than the normal compression force of the bottom elastomeric seal; when in the sealed state, if the internal pressure generated by the contained content exceeds the external pressure, due to the presence of the positioning bead, the detachable sealed straw can undergo slight displacement along the axis of the large cap through the compression of the balls of the positioning bead, creating a gap between the detachable sealed straw and the elastomeric seal to release excessively high internal pressure caused by the content. Once the pressure is relieved, the detachable sealed straw returns to its compressed state due to the axial force of the positioning bead and the action of the cap's concave joint, re-establishing the seal.

Where the positioning beads are situated within the large cap, and the concave joint of the rotating axis is designed into the spout.

Preferably, the detachable straw assembly includes a series of positioning beads, and the spout. Preferably, the spout comprises a spout body, spout lead-in, and handle.

Preferably, the large cap includes walls defining a recess, guiding assemblies and grooves for the easy removal of the detachable sealed straw, a concave joint of the rotating axis, and guiding grooves for housing the detachable sealed straw and elastomeric seal, used to lock the detachable sealed straw in the closed and open positions, and keep it mounted on the cap.

Preferably, when the user rotates the handle of the detachable straw assembly outward along the concave joint of the rotating axis of the cap and moves it to the open position, the interaction of the positioning beads, detachable straw assembly, and elastomeric seal keeps the detachable straw assembly held in the open position without free forward movement.

Preferably, when the user rotates the handle of the detachable straw assembly inward along the concave joint of the rotating axis of the cap moving towards the closed position, the interaction of the positioning beads, detachable straw assembly, elastomeric seal, and the spout body of the detachable straw assembly and the elastic compression of the elastomer work together to hold the detachable straw assembly in the closed position without free forward movement.

Preferably, the spout body, rotating shaft, and positioning beads are located on the detachable sealed straw, simultaneously, and the concave joint of the rotating axis and the elastomeric seal are situated on the large cap.

The disclosed technical solution relates to a lid assembly for drinking vessels, in one example, the lid assembly can include a rotatable detachable sealed straw. The rotatable detachable sealed straw contains positioning beads and a spout, the spout can form a spout body that rotates within the concave joint of the rotating axis of the lid assembly, a conduit for the flow of the vessel's contents, a spout lead-in for the channel, a blind hole for assembling the positioning beads, and a handle. In some examples, the detachable sealed straw can be configured to perform one or more of the following: (1) rotate between a closed position and an open position, in the closed position, the detachable sealed straw, elastomeric seal, and large cap interact to help prevent spillage of the vessel's contents; in the open position, the detachable sealed straw, elastomeric seal, and large cap interact to allow communication between the content passage and airflow channel, permitting consumption of the vessel's contents, (2) lock in place at the closed position and open position, (3) remain attached to the large cap during rotation between the closed and open positions, (4) be removable from the cap, allowing the cap and detachable sealed straw to be separated for thorough cleaning.

BRIEF DESCRIPTION OF THE DRA WINGS

To provide a clearer understanding of the embodiments of the present invention or the technical solutions in existing technology, the following will briefly introduce the drawings used in the description of the specific embodiment or existing technology. It should be evident that the drawings described below represent some embodiments of the present invention, and other drawings can be obtained based on these drawings by those skilled in the art without creative effort.

Figure 1:
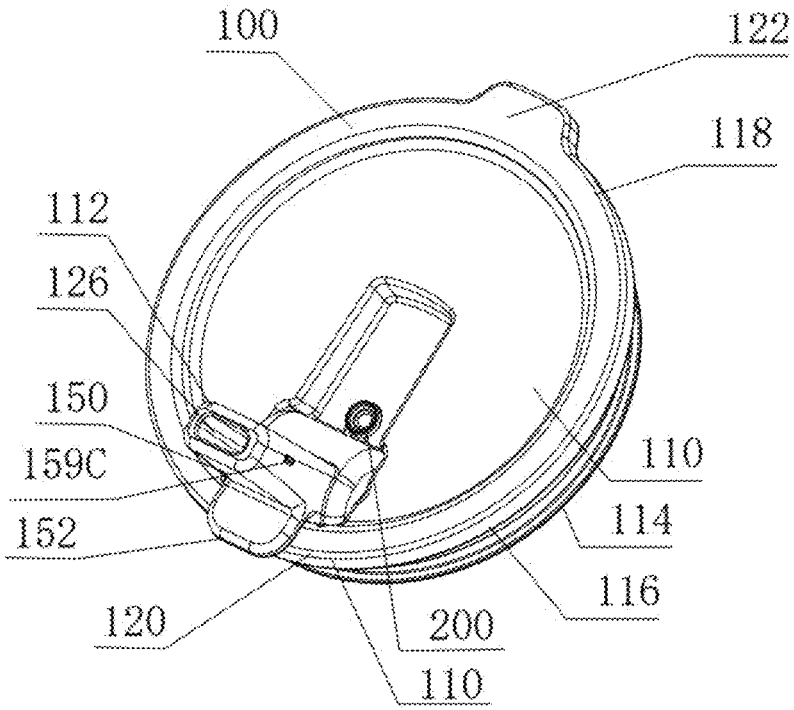
FIG. 1 shows an isometric top view of an exemplary lid assembly in the open position.
Figure 22:
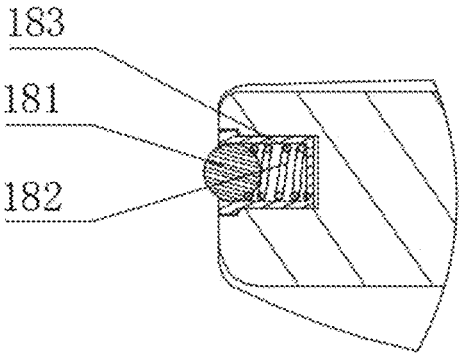

FIG. 22 provides a sectional view focusing on the rotating positioning bead of the detachable sealed spout assembly from the exemplary lid assembly in FIG. 1, detailing the mechanism enabling smooth rotational movement and secure attachment.

DETAILED DESCRIPTION OF THE EMBODIMENTS

In the following descriptions of various examples and components of the disclosure, reference is made to the accompanying drawings which form part thereof, and herein by way of illustration, various exemplary structures and environments are shown in which aspects of the disclosure may be implemented. It should be understood that alternative structures and environments can be utilized, and structural and functional modifications may be made to the described structures and methods without departing from the scope of the disclosure. Moreover, while terms such as "front," "rear," "top," "base," "bottom," "side," "forward," and "backward" may be used herein to describe various exemplary features and elements, these terms are used for convenience only, for instance, based on the orientation of the exemplary illustrations provided in the drawings and/or typical orientations during use. Nothing in this specification shall be construed as requiring any three-dimensional or spatial orientation in order to fall within the scope of the claims.

In some embodiments of the present disclosure, it provides a container with detachable sealed straw, including a container and a lid assembly 100 covering the container.

Figure 2:
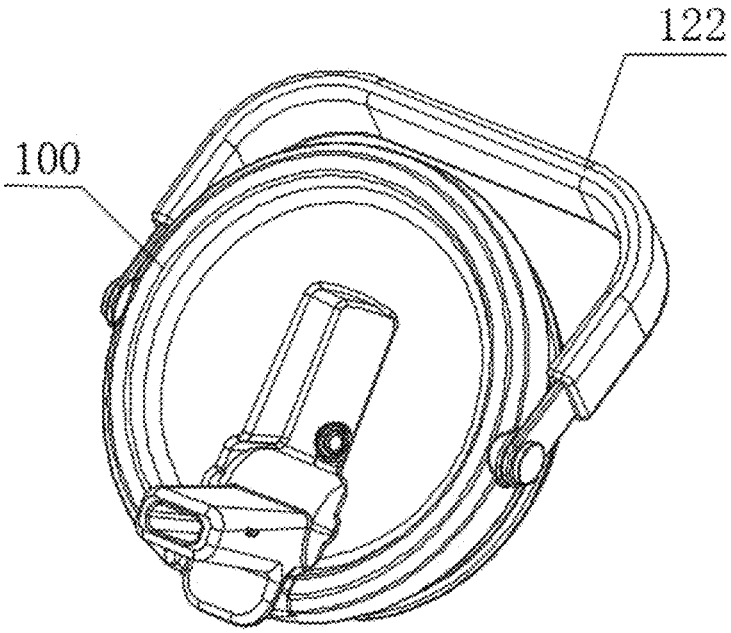
FIG. 2 shows another isometric top view of an exemplary lid assembly in the open position that provides additional detail highlighting the different cap bodies.
Figure 3:
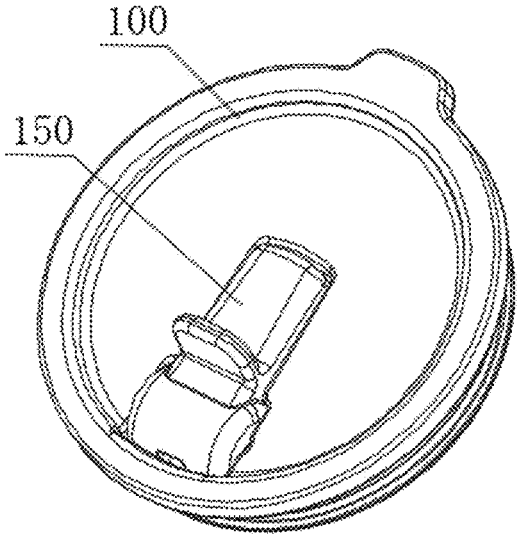
FIG. 3 shows an isometric top view of an exemplary lid assembly in the closed position.
Figure 4:
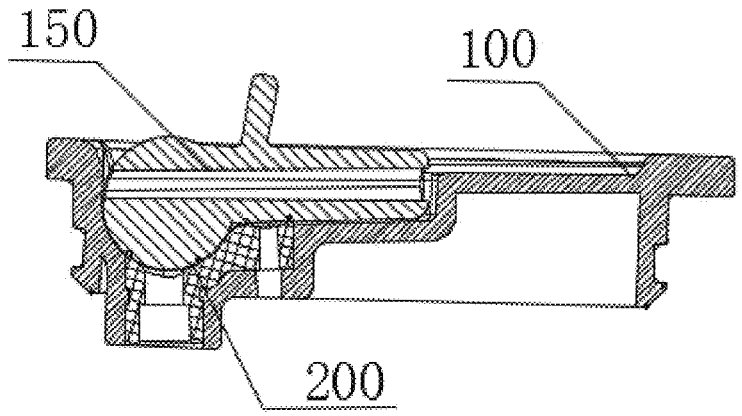
FIG. 4 shows a cross-sectional side view of an exemplary lid assembly in the closed position.
Figure 5:
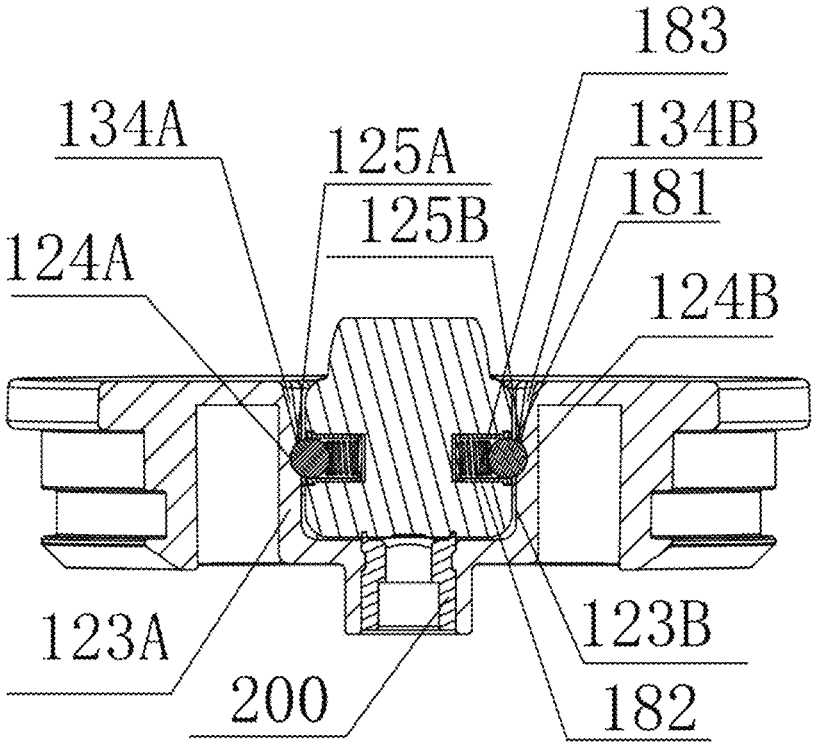
FIG. 5 shows a longitudinal sectional view of the rotating axis of an exemplary lid assembly in the closed position.
Figure 6:
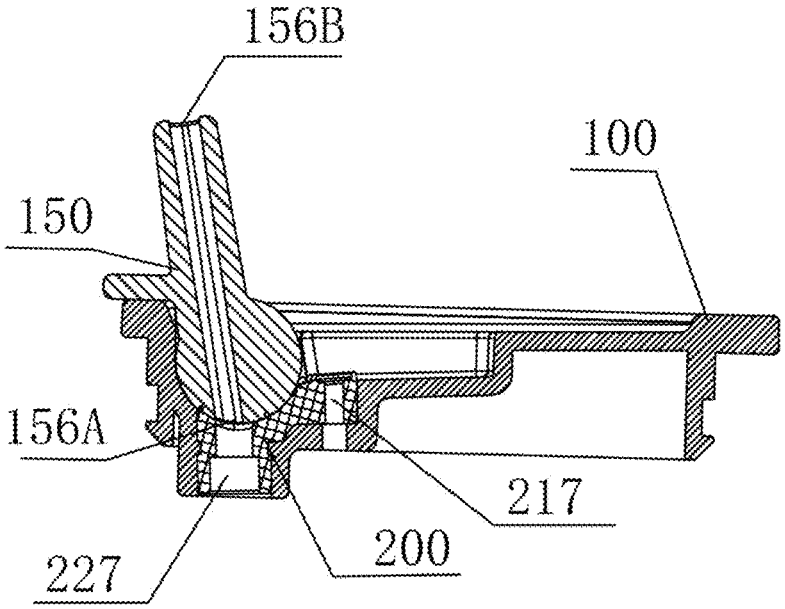
FIG. 6 shows a cross-sectional side view of an exemplary lid assembly in the open position.
Figure 7:
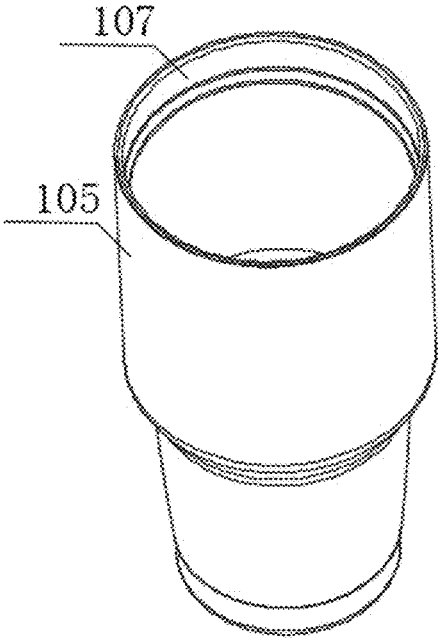
FIG. 7 and FIG. 8 show isometric views of exemplary containers of differing shapes designed to accommodate the exemplary lid assembly depicted in FIG. 1.
Figure 8:
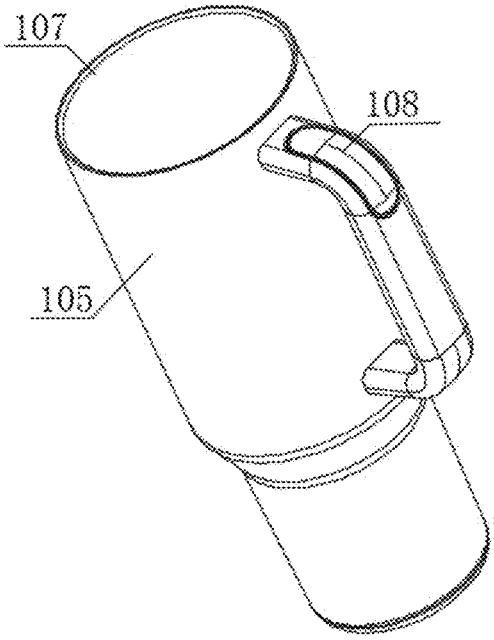

FIG. 1 illustrates an exemplary lid assembly 100, which generally includes a cap 110, a closable rotatable spout assembly 150, and an elastomeric seal component 200. The rotatable spout assembly 150 is configured to rotate between an open and a closed position to selectively open or close fluid passage 156 and channel 227 of the elastomeric seal component 200, simultaneously also capable of selectively opening or closing airflow passage 217 of the elastomeric seal component 200. FIG. 1 provides an isometric view of the exemplary lid assembly 100 where the rotatable spout assembly 150 is in the open position relative to container 105. Cap 110 may also include sidewalls 114 that define a recess 116 for accommodating a gasket, providing a seal between lid assembly 100 and container 105. However, other sealing techniques for securing cap 110 to container 105 are anticipated, including threaded engagement and elastomeric seals. Cap 110 can further include a rim 118 for engaging container opening 107, the rim potentially incorporating a top wall 120 and optional tabs 122 extending from top wall 120 to assist users in removing lid assembly 100 from container 105. Alternatively, a dedicated handle grip could be incorporated as anticipated (as seen in FIG. 2). FIG. 3 depicts an isometric view of the exemplary lid assembly 100 with the rotatable spout assembly 150 in the closed position relative to container 105. FIG. 4 illustrates a sectional view showing the direction of rotation of the exemplary lid assembly 100 in the closed position. FIG. 5 presents an axial cross-section around the locking axis of the exemplary lid assembly 100 in the closed position. FIG. 6 portrays a sectional view of the exemplary lid assembly 100 in the open position, depicting a cross-section of contents from channel 227 of elastomeric seal 200 flowing through spout assembly channels 156A and 156B. Users draw content out of container 105 via spout assembly channel 156B, while air flows through airflow passage 217 of elastomeric seal 200 to equalize pressure inside container 105 with atmospheric pressure outside. FIG. 7 illustrates an isometric view of an exemplary container 105 designed to receive lid 100. As previously noted, cap 110 may incorporate sidewalls 114 defining recess 116 for a gasket to ensure a seal between lid assembly 100 and container 105. Other sealing mechanisms for securing cap 110 to container 105, such as threading and elastomeric seals, are also expected. Cap 110 can have a rim 118 for engaging container opening 107, possibly featuring top wall 120 and optional tabs 122 extending from it to aid removal of lid assembly 100 from container 105. An integrated handle grip might also be considered as an alternative option.

Figure 9:
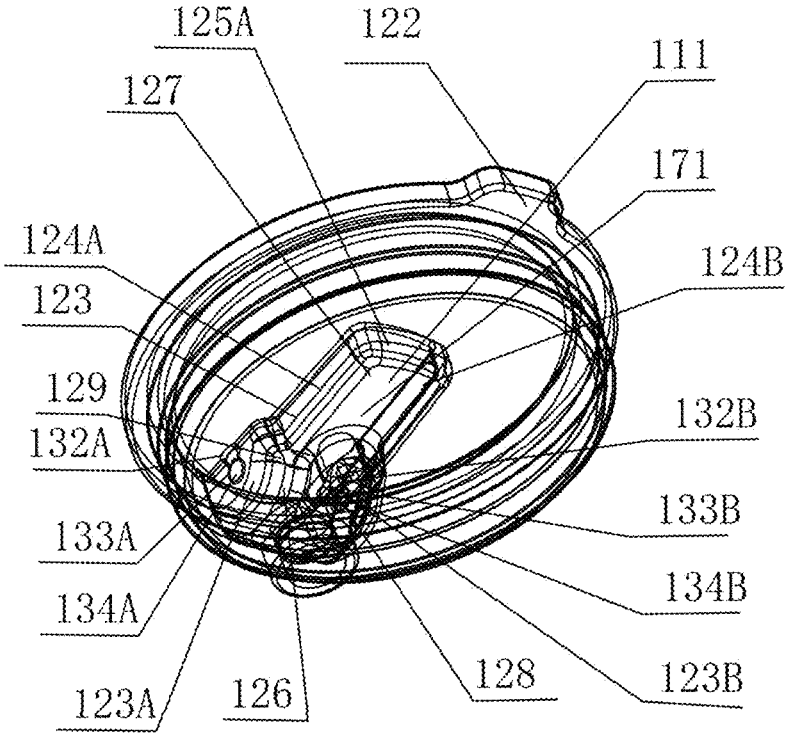
FIG. 9 shows an isometric top view of the large cap from the exemplary lid assembly illustrated in FIG. 1.

FIG. 9 displays an isometric top perspective view of the large cap 110 from the exemplary lid assembly 100, with the closable rotatable spout assembly 150 and elastomeric seal component 200 removed. Cap 110 can feature intermediate walls 123A, 124A, 125A, 124B, 123B, 125B forming integral intermediate wall 123 beneath rim 118. On intermediate wall 123, guide slots 132A and 132B are formed to facilitate assembly and easy removal of the closable detachable spout assembly. Also on intermediate wall 123 are joint concavities 134A and 134B for the rotational axis, smoothly transitioning to guide slots 132A and 132B via rounded surfaces 133A and 133B for seamless operation.

The lower support wall 126, along with support walls 129 and 127, form an integral base support structure 171. Together, intermediate wall 123, guide slots 132A and 132B, joint concavities 134A and 134B, rounded surfaces 133A and 133B, and base support structure 171 constitute channel 111, designed to house the closable detachable spout assembly 150 and elastomeric seal component 200.

Figure 11:
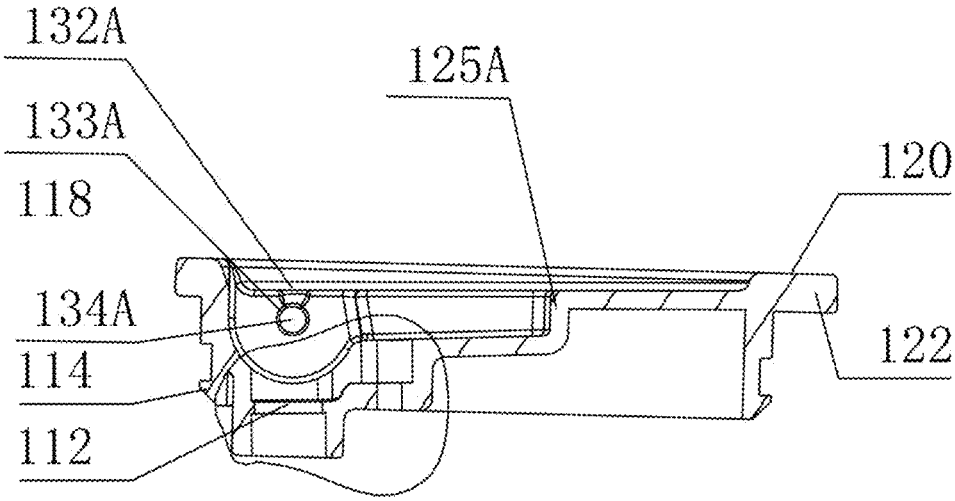
FIG. 11 shows a lateral cross-sectional view of the large cap from the exemplary lid assembly presented in FIG. 1.
Figure 12:
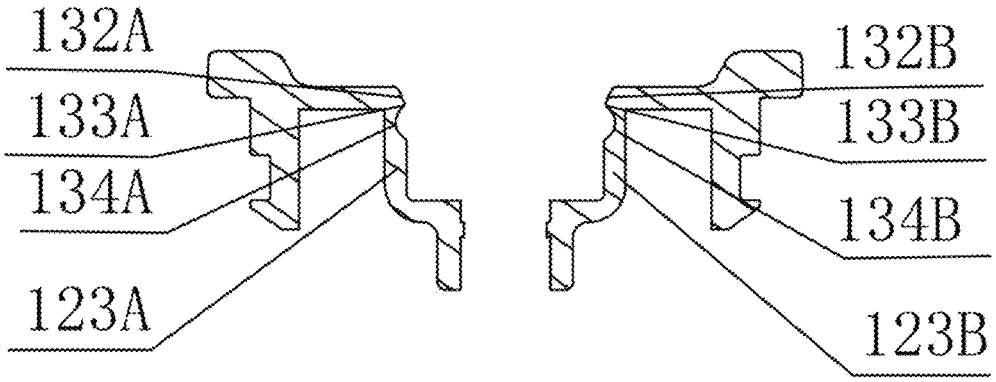
FIG. 12 shows a longitudinal sectional view of the rotating axis of the large cap from the exemplary lid assembly featured in FIG. 1.

The configuration guiding the assembly and ease of disassembly of the closable detachable spout assembly, including guide slots 132A and 132B and the rotational axis joint cavities, will be detailed in FIGS. 11 and 12. The construction of elastomeric seal component 200 within support structure 171 is elaborated upon in FIG. 13.

The relationship among the closable detachable spout assembly 150, elastomeric seal component 200, and large cap 100 is discussed; see FIGS. 4, 5, 6, 15, and 18. Regardless of whether in the open or closed position, the spout body 151 presses against the equi-height sealing flanges 221 of the elastomeric seal component 200, causing a slight elastic deformation for a sealing effect. The tab or handle 154 is constructed to allow users to selectively pivot the closable detachable spout assembly 150 about axis 160 to an open position, utilizing the elastic deformation of the equi-height sealing flanges 221 of the elastomeric seal component 200 to connect the consumable flow path 227 of the elastomeric seal component 227 and the container's fluid pathway 156, while exposing the airflow passage 217 of the elastomeric seal 200.

Alternatively, one can optically rotate the closable detachable spout assembly 150 about axis 160 to a closed position to sever the connection between the consumable flow path 227 of the elastomeric seal component 227 and the container's fluid pathway 156. This relies on the retention beads of the closable detachable spout assembly being positioned within the joint cavities 134A and 134B of the cap body 110. The compression of the elastomeric seal component's equi-height sealing flanges 221 against the spout body 151 results in a light elastic deformation for a sealing effect, and the friction lock-in-place due to the compressive force between the spout body 151 and the elastomeric seal component achieves a secure fit. Additionally, the spout lead 155 pressing against sealing flange 211 of the elastomeric seal component 200 aids in cutting off passage 217 from exterior access to achieve airtightness, helping prevent spillage of the container's contents.

Figure 10:
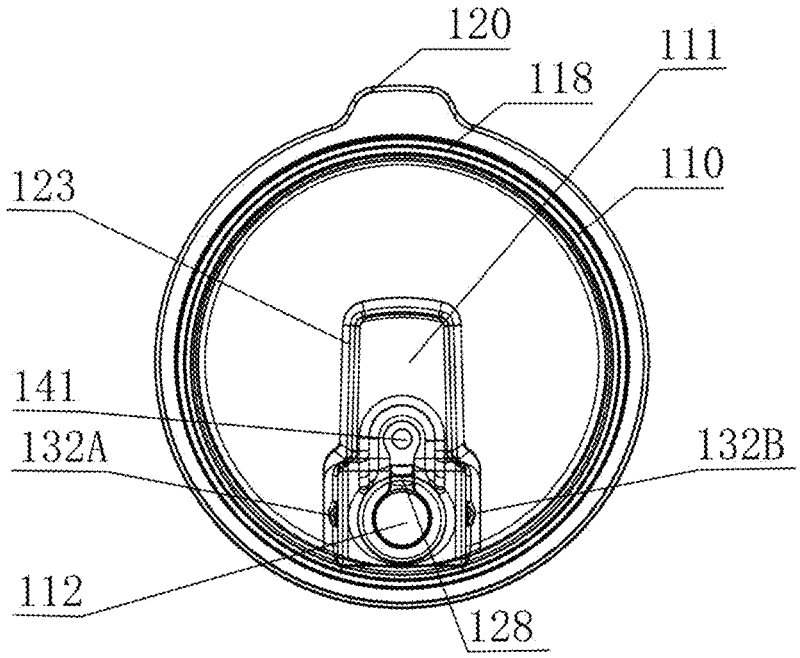
FIG. 10 shows a top view of the large cap from the exemplary lid assembly showcased in FIG. 1.

FIG. 10 presents a top view of the large cap 110 from the exemplary lid assembly 100 in FIG. 1, illustrating walls 123 defining recesses, guide slots 132A and 132B for the assembly and disassembly of the closable detachable spout assembly 150, and channel 111 for housing the spout assembly 150 and elastomeric seal component 200.

FIG. 11 showcases a lateral cross-sectional view of the large cap 110 from the exemplary lid assembly 100, delineating the normal axis of the joint cavity 134A, aligned coaxially with the central axis 160 of the spout body 151 of the closable detachable spout assembly 150. When elastomeric positioning beads 180A, 180B are fitted into blind holes 180C, 180D of the spout body 151, they too align co-axially, ensuring the dependable rotation of the spout assembly 150. The joint cavities 134A, 134B broaden towards the top face of cap 110 as guide slots 132A and 132B, aiding in the guided entry of the spout assembly 150 onto joint cavities 134A, 134B from the top of cap 110. Joint cavities 134A, 134B accommodate the balls ends 181 of positioning beads 180A, 180B. Due to the axial depth of joint cavities 134A, 134B, FIG. 12 offers a longitudinal sectional view of the large cap 110's rotating axis from the exemplary lid assembly 100, clearly depicting this depth relation and the widening guide slots 132A and 132B. It shows the incorporation of positioning beads 180A, 180B with preloads of 5-50 N, ensuring they remain securely in place under minimal forces.

Figure 13:
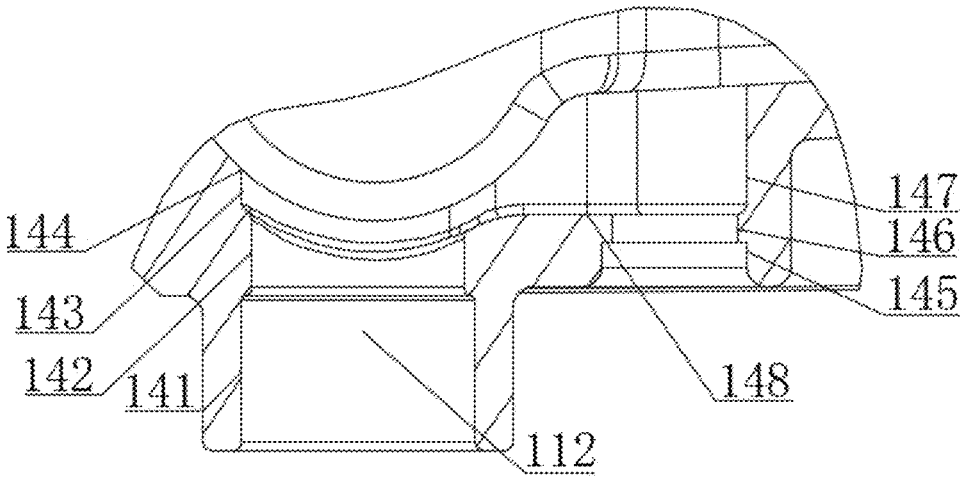
FIG. 13 shows a magnified section of the large cap from FIG. 10, providing closer inspection of certain features.

FIG. 13 provides a detailed view of configuration 128 in support structure 171 where the elastomeric seal component 200 is housed. Within the channel, supporting surfaces 143 and seat 142 create a retention notch 141, facilitating insertion of the first portion 220 of the elastomeric seal component 200, alongside another supporting surface 147 and seat 146 to accommodate the second part 210, guarding against the dislodgement of the first section 220. The third segment, identified by 148, serves as a connecting piece with an irregular shape, simultaneously constraining the degrees of freedom of both the first and second sections, enhancing overall stability.

Figure 14:
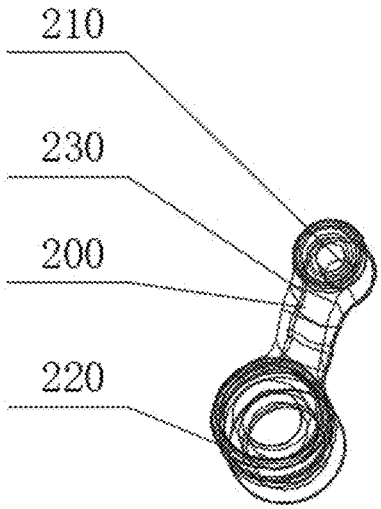
FIG. 14 shows an isometric top view of the elastomeric seal component 200 from the exemplary lid assembly in FIG. 1.

FIG. 14 depicts an isometric top view of the elastomeric seal component 200 from the exemplary lid assembly 100 in FIG. 1, comprising three distinct sections: the first part, designated as the consumable flow path, seal, and fixation segment 220; the second part, serving as the air pathway, seal, and fixation segment 210; and the third part, 230, functioning as a connector between segments 210 and 220. Its purpose is to act as an integral construction element, limiting the mobility of both the first and second portions, thereby enhancing structural integrity.

Figure 15:
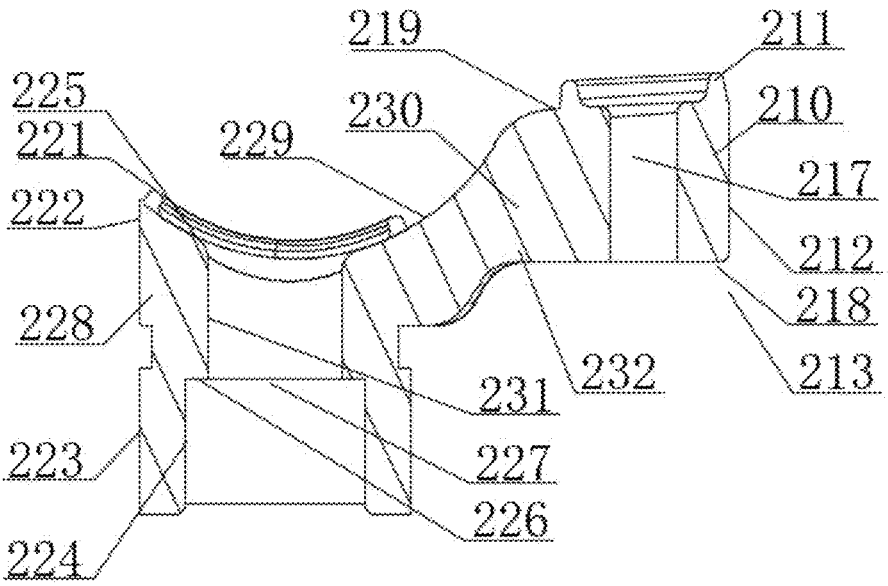
FIG. 15 shows a lateral cross-sectional view of the elastomeric seal component 200 from the exemplary lid assembly in FIG. 1.

FIG. 15 details the intricate design of the elastomeric seal component 200, emphasizing its stable mounting within the configuration 128 of support structure 171, featuring equi-height sealing flanges 221 and 211 for sealing purposes. It ensures secure accommodation at regions 224 and 226, allowing straw insertion while firmly locking in place, promoting consumption of contents. A passageway for airflow is created at location 217, operating in conjunction with the position of the closable detachable spout assembly 150, whether open or closed, to achieve sealing via the interaction of components 150, 200, and cap 110. The primary section of the elastomeric seal component 200 involves the consumable flow path 227, seal, and fixation segment 220, where concavity 228 locks into the reduced area of large cap 100's configuration 128, supporting base 222 above to maintain an equi-height sealing flange 221 upon assembly. This ensures product precision. Beneath, stabilizing elements 224 and 226 form dimensions enabling firm straw insertion and secure retention. Similarly, the secondary section encompasses the air pathway, seal, and fixation segment 210, employing direct press-fit design. Herein, concavity 218 mates with the platform surface of large cap 100, supporting base 219 above to uphold sealing flange 211 upon assembly into large cap 100's configuration 128, guaranteeing accuracy. Section 230, linking parts 210 and 220, functions as an integral structure whose peculiar shape limits the degrees of freedom of the two segments, enhancing total stability. This unified approach ensures each component works in harmony, crucial for the seal's efficiency and the lid assembly's leak-proof performance, providing assurance to users in various conditions, including when the container is tipped or inverted.

Figure 16:
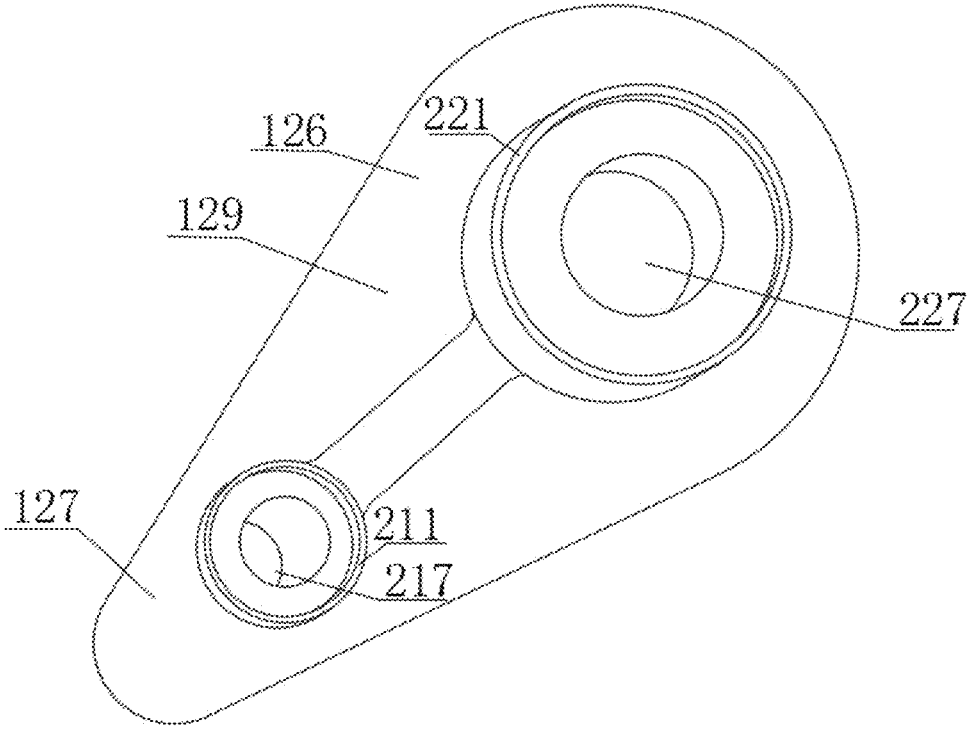
FIG. 16 shows a partial view of the top assembly featuring the large cap 100 and elastomeric seal component 200, offering insight into their integration within the exemplary lid assembly illustrated in FIG. 1.

FIG. 16 illustrates a partial view of the large cap 110 with the elastomeric seal component 200 assembled, presenting a clear depiction of the fitting relationship between the elastomeric seal component 200 and the support structure 171's configuration 128. Top surface 191 of support structure 171 and surface 229 of elastomeric seal component 200 align flushly, showcasing the assembly precision that ensures formation of equi-height sealing flanges 221 and 211 for sealing and rotation.

Figure 17:
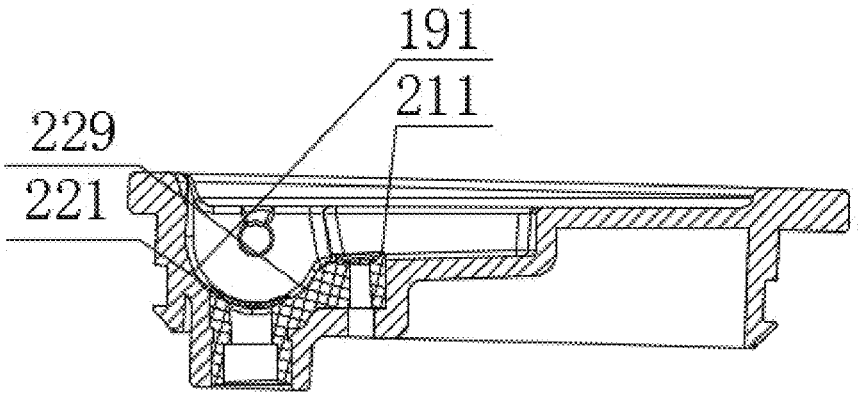
FIG. 17 shows a sectional view of the large cap 100 assembled with the elastomeric seal component 200 from the exemplary lid assembly presented in FIG. 1, revealing internal details of their assembly.

FIG. 17 reveals a cross-sectional view of the assembly of large cap 100 with the elastomeric seal component 200, further elucidating the conformity of surfaces 191 and 229, reiterating the assembly relationship between the elastomeric seal component 200 and configuration 128 of support structure 171. This ensures proper formation of equi-height sealing flanges 221 and 211 for sealing, locking, and rotation.

Figure 18:
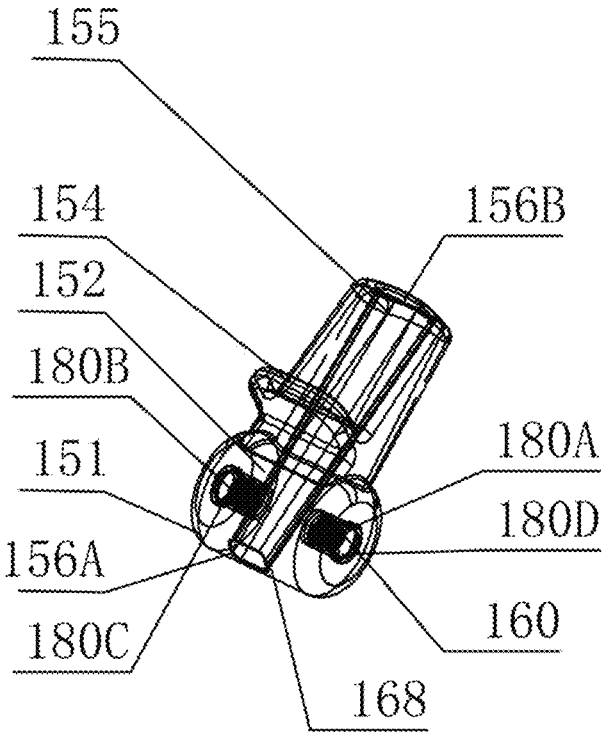
FIG. 18 shows an isometric top view of the detachable sealed spout assembly from the exemplary lid assembly depicted in FIG. 1, showcasing its external profile and layout.
Figure 19:
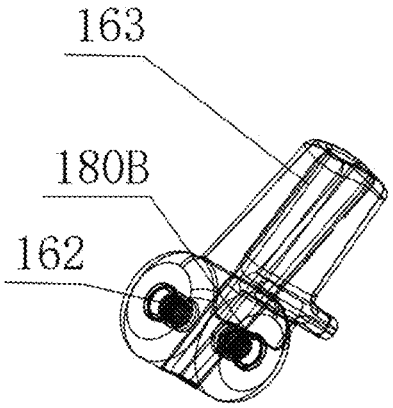
FIG. 19 shows an isometric bottom view of the detachable sealed spout assembly from the exemplary lid assembly in FIG. 1, offering a perspective of its underside and potential contact surfaces.
Figure 20:
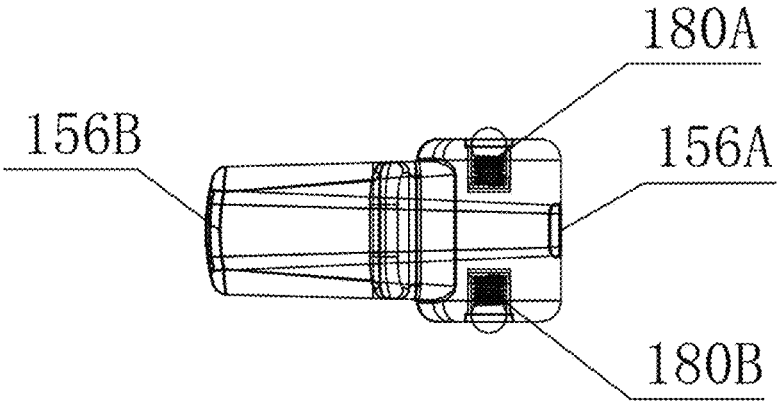
FIG. 20 shows a top view of the detachable sealed spout assembly from the exemplary lid assembly in FIG. 1, providing a clear overview of its upper surface.
Figure 21:
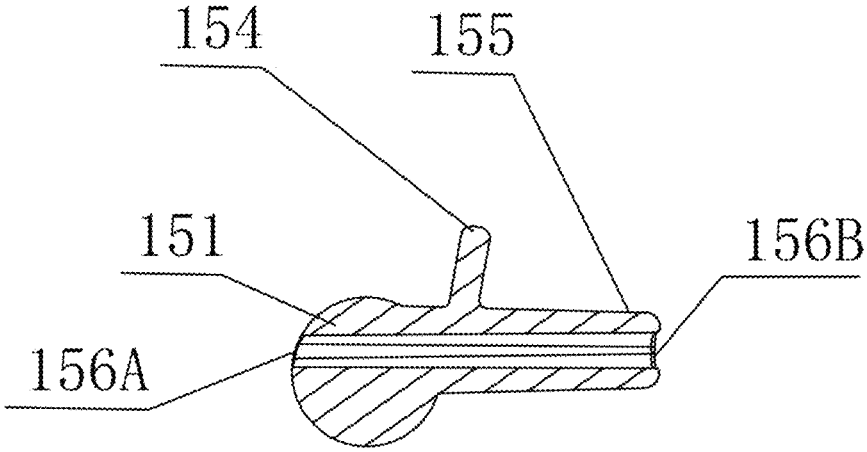
FIG. 21 shows a lateral cross-sectional view of the detachable sealed spout assembly from the exemplary lid assembly in FIG. 1, unveiling internal components and their arrangement.

FIG. 18 exhibits an isometric top view of the closable detachable spout assembly 150 from the exemplary lid assembly 100. FIG. 19 showcases an isometric bottom view of the same component. In FIG. 20, a straightforward top view of the closable detachable spout assembly 150 is displayed. And in FIG. 21, a lateral cross-section view of the component is shown. Closable detachable spout assembly 150 comprises elastomeric positioning beads 180A, 180B, and straw 168. straw 168 facilitates the rotation of spout body 151 around axis 160 (coincident with joint cavities 134A and 134B), enables the container's fluid pathway 156, and incorporates stem 155, which leads to blind holes 180C/180D for elastomeric positioning beads 180A, 180B. Tab or handle 154 allows selective rotation of the closable detachable spout assembly 150, offering improved user experience. Pathway 156 is connected through sections 156A and 156B. Spout body 151 houses blind holes 180C/180D for fixing elastomeric positioning beads 180A, 180B, and the assembly securely locks into the guide slot 111 of the large cap when combined with the elastomeric seal component.

FIG. 22 illustrates a cross-sectional view of the rotatable elastomeric positioning bead 180 in the closable detachable spout assembly 150 of the exemplary lid assembly 100. The rotatable elastomeric positioning bead primarily consists of three parts: casing 183, balls end 181, and stainless-steel spring 182. Functioning as a standard component, balls end 181 is subject to preload exerted by stainless steel spring 182, ensuring its secure placement within casing 183. When the casing 183 is fixed, any change in squeezing pressure causes balls end 181 to contract or extend within the elastic range of the stainless-steel spring 182, maintaining constant contact under pressure, leading to outward radial expansion of the balls end 181, attempting to restore its initial state.

To operate the closable detachable spout assembly 150, the user may individually or concurrently grasp handle 154 to pivot the assembly from the open to the closed position. Rotating along spout body 151's axis 160, in conjunction with the elastomeric seal component 200 and the recesses of large cap 110, the spout body 151 and the elastomeric seal component undergo elastic compression and frictional engagement, achieving a secure lock and seal that prevents spillage of the container's contents.

Additionally, for cleaning purposes or if the user wishes to remove the closable detachable spout assembly 150 from the cap 110, the assembly can be selectively detached from the cap 110, requiring a force ranging from 0.5 to 50 N. To detach the closable detachable spout assembly 150 from cap 110, from beneath the lid assembly 100, the user can grip the handle 154 on the spout assembly 150, flipping it to the open position, then manually pull the spout body 151 off using the suction stem. This disengagement occurs either by compressing the elastomeric positioning beads' balls directly or by applying an axial twist, causing the spout to separate from the cap 110, allowing thorough cleaning of cap 110 once the spout assembly 150 is removed.

To reinstall the closable detachable spout assembly 150 onto cap 110, the spout assembly should be positioned near the cap's guide slot, following the track defined by guides 132A and 132B. Pressing down on the spout body 151 and suction stem 155, the elastomeric positioning beads 180A, 180B will, under thumb pressure and guided by tracks 132A and 132B, glide over arcs 133A and 133B smoothly into joint cavities 134A and 134B, requiring a force between 5 and 50 N. Simultaneously, the spout body 151 and the elastomeric seal establish an elastic compression and frictional engagement, securing the spout assembly 150 within the cap's guide slot 111, thus maintaining its proper alignment on cap 110.

When the closable detachable spout assembly 150 is held in the closed position, pressures from the liquid acting through openings in cap 110 and vent holes impinge upon the spout body 151 and suction stem 155. The assembly's connection to cap 110 is maintained by the pre-tension generated from the compression of dual elastomeric positioning beads within cavities 134A and 134B. The direction of force experienced by the elastomeric beads and the pressure from the inverted filled container are perpendicular. Thus, the force on the elastomeric beads between the spout assembly 150 and cap 110 better resists the pressure from an inverted filled container, such that in the example depicted in FIG. 3, the forces produced by the dual elastomeric beads could be in the range of 5 N to 50 N. Additionally, this pre-compression tension can be designed so that under hot and/or pressurized liquids, slight contraction due to internal overpressure will cause the spout assembly 150 to vent slightly against the elastomeric seal 200, allowing for ventilation. Contrary to fully sealed non-venting/leakproof caps or press-fit caps, this is desirable because it makes the press-fit cap less prone to completely detaching from the container when faced with highly pressurized fluids, allowing pressure relief without complete detachment. In the case illustrated in FIG. 3, the holding force provided by the elastomeric beads on the cap can be less than the retaining force between the cap and the container. For instance, cap 110 might adhere to the container with a first force, and the spout assembly 150 adheres to cap 110 with a lesser second force, ensuring that before the lid assembly 100 releases from the container, the spout assembly 150 will release from cap 110. As such, the force exerted by the elastomeric beads on cap 110 can be less than the force between the cap 100 and the container, causing the spout assembly 150 to vent prior to the gasket, preventing rapid overflow of the container.

Furthermore, the surface roughness of the friction region on the elastomeric seal 200 interacting with the closable detachable spout assembly 150 can be adjusted according to the desired level of feedback for the user. For instance, reducing the surface roughness of the elastomeric seal 200 that interacts with the spout assembly 150 can allow easier movement of the spout assembly 150 from the closed position to the open position and vice versa during use.

The closable detachable spout assembly 150 can also incorporate channels, aligned as vents when the assembly is in the open position. Moreover, the spout assembly 150 can include pathways formed alongside the first side wall and second side wall of the large cap 110, ensuring unobstructed airflow. When in the closed position, the spout assembly 150's rear constructions 162 and 163 seal the consumable pathway 227 and vent hole 217, aiding in prevention of content spillage from the container and maintaining atmospheric pressure balance.

It is envisaged that the cap's rotating joint cavity can also be reverse engineered, with the spout assembly incorporating elastomeric positioning beads, offering alternative design configurations.

Various examples have been disclosed herein concerning the invention, referring to the accompanying drawings. However, the disclosure aims to provide illustrative examples relating to features and concepts associated with the invention rather than limit the scope thereof. Experts within the domain will understand that myriad permutations and revisions are feasible for the discussed illustrations, all the while upholding the core principles and boundaries of the invention.

Molding Process and Assembly Method:

To form the main cap, cap 110 can be created using an injection molding process where the cap body 110A is molded in one shot with a polymer material.

For the formation of the spout piece, spout 168 can be shaped via an injection molding process, with spout 168 being molded in one shot utilizing a polymeric material.

Regarding the elastomeric seal 200, it can be fashioned through either an injection molding procedure or compression molding, involving a single-shot injection or compression molding of the elastomeric high-polymer compound to create the elastomeric seal 200.

To assemble the closable detachable spout component 150, the spout 168 and the resilient rotational elastomeric positioning beads are press-fitted, with interference fit ensuring the hood and bead assembly withstand repeated thermal shock testing from high temperatures of 80 degrees Celsius to low temperatures of −30 degrees Celsius for 3,000 cycles without separation.

It must be noted that in this document, relational terms such as "first" and "second" are used merely to distinguish one entity or action from another, without necessarily implying any actual relationship or order between them. Furthermore, the term "comprising," "including," or any other variant thereof intends to encompass non-exclusive inclusion, whereby a process, method, item, or device including a series of elements does not exclude additional elements, whether listed or inherent to the process, method, article, or apparatus. Unless more limitations apply, the presence of the phrase "comprising a . . . " does not preclude the existence of further identical elements in the process, method, item, or device that includes said element(s).

Although embodiments of the present invention have been shown and described, it will be understood by those skilled in the art that various changes, modifications, substitutions, and alterations can be made without departing from the principle and spirit of the invention, the scope of which is defined by the appended claims and their equivalents.

What is claimed is:

1. A container with detachable sealed straw, comprising:

a container; and a lid assembly covering the container;

wherein the lid assembly comprises walls defining a recess, guiding grooves facilitating assembly and easy removal of the detachable sealed straw, and a concave surface of a rotating axis joint; the guiding grooves is configured to house the detachable sealed straw and accommodate an elastomeric seal;

wherein the detachable sealed straw comprises positioning balls, a spout forming a body capable of rotating within the concave surface of the rotating axis joint of the lid assembly, a channel for flowing of contents from the container, a spout lead-in part, a blind hole for assembling the positioning balls, and a handle allowing the detachable sealed straw to rotate between an open position for consuming the contents and a sealed position;

wherein the elastomeric seal is tightly fitted into the lid assembly, and when the detachable sealed straw rotates to a sealed position, it creates a seal for enclosure of the container's contents; when the detachable sealed straw rotates to an open position, it forms a continuous connection with internal contents while ensuring unobstructed airflow;

wherein the detachable sealed straw is equipped with the handle and the positioning balls, the positioning balls are configured to rotate along the concave surface of the rotating axis joint of the lid assembly;

wherein the detachable sealed straw is configured to rotate between the sealed position at the concave surface of the rotating axis joint of the lid assembly and the opening position;

wherein the detachable sealed straw is configured to lock in place by frictional compression of an elastic force between the cover's rotating concave joint surface, the positioning balls, a main body of the detachable sealed straw's spout, and the elastic seal when transitioning between the closing and opening positions;

wherein the lid assembly further comprises a channel configured to receive the detachable sealed straw and the elastomeric seal, and the guiding grooves limit lateral movement of the detachable sealed straw while allowing rotational movement;

wherein the detachable sealed straw is configured to be fixed on the lid assembly and be removed directly by hand, either by pulling out the spout lead-in part and handle of the detachable sealed straw against the compression of the balls of the positioning balls, which allows its removal from the cover, or by manually flipping it around the axis outward, leading to the detachment of the spout due to the compression of the balls of the positioning balls from the cover;

wherein the lid assembly further comprises a channel configured to receive the detachable sealed straw, and the guiding grooves restrict lateral movement of the detachable sealed straw while permitting rotational movement;

wherein an axial compressive force of the positioning balls are greater than a normal compressive force of the elastomeric seal; and wherein the positioning balls are located within the lid assembly, and the rotating axis concave joint is designed within the spout.

2. The container with detachable sealed straw according to claim 1, wherein the detachable straw assembly comprises a series of positioning balls and a spout.

3. The container with detachable sealed straw according to claim 2, wherein the spout comprises a spout body, a spout lead-in part, and a handle.

4. The container with detachable sealed straw according to claim 3, wherein the lid assembly comprises walls defining a recess, guiding assemblies that facilitate installation and easy removal of the detachable sealed straw, guiding grooves for the detachable sealed straw and the elastomeric seal, a rotating axis concave joint; and the lid assembly is configured to lock the detachable sealed straw in the sealed position and opening position, as well as to retain the detachable sealed straw onto the cover.

5. The container with detachable sealed straw according to claim 4, wherein when a user turns the handle of the detachable sealed straw outward along the concave joint of the rotation axis of a large cap, the positioning bead, detachable straw assembly, and elastomeric seal interact to hold the detachable sealed straw in the open position without any free forward motion.

6. The container with detachable sealed straw according to claim 5, wherein when the user pushes the handle of the detachable sealed straw inward along the concave joint of the rotation axis of the large cap toward the closure position, the positioning bead, detachable sealed straw, elastomeric seal, body of the detachable straw, and compression of the elastomeric seal interact to hold the detachable sealed straw securely in the closed position without any free forward motion.

7. The container with detachable sealed straw according to claim 6, wherein the spout body, rotating shaft, and positioning bead are positioned on the detachable sealed straw, simultaneously, and the concave joint of the rotation axis and the elastomeric seal are located on the large cap.

* * * * *